US009909831B2

(12) United States Patent
McPherson

(10) Patent No.: US 9,909,831 B2
(45) **Date of Patent: *Mar. 6, 2018**

(54) ARCHERY BOW CAM

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/166,094

(22) Filed: May 26, 2016

(65) Prior Publication Data

US 2016/0273867 A1 Sep. 22, 2016

Related U.S. Application Data

(63) Continuation of application No. 14/230,659, filed on Mar. 31, 2014, now Pat. No. 9,354,017, which is a continuation of application No. 12/895,610, filed on Sep. 30, 2010, now Pat. No. 8,683,989.

(60) Provisional application No. 61/247,473, filed on Sep. 30, 2009.

(51) Int. Cl.
*F41B 5/10* (2006.01)

(52) U.S. Cl.
CPC ..... *F41B 5/105* (2013.01); *F41B 5/10* (2013.01)

(58) Field of Classification Search
CPC ..... F41B 5/105; F41B 5/10
See application file for complete search history.

(56) References Cited

U.S. PATENT DOCUMENTS

| | | | |
|---|---|---|---|
| 3,486,495 | A | 12/1969 | Allen |
| 4,060,066 | A | 11/1977 | Kudlacek |
| 4,064,862 | A | 12/1977 | Groner |
| 4,438,753 | A | 3/1984 | Simonds |
| 4,461,267 | A | 7/1984 | Simonds et al. |
| 4,515,142 | A | 5/1985 | Nurney |
| 4,519,374 | A | 5/1985 | Miller |
| 4,739,744 | A | 4/1988 | Nurney |
| 4,774,927 | A | 10/1988 | Larson |
| 4,838,236 | A | 6/1989 | Kudlacek |
| 4,986,250 | A | 1/1991 | Darlington |
| 5,040,520 | A | 8/1991 | Nurney |
| 5,368,006 | A | 11/1994 | McPherson |
| 5,791,322 | A | 8/1998 | McPherson |
| 5,791,323 | A | 8/1998 | Dunlap |
| 5,934,265 | A | 8/1999 | Darlington |
| 5,960,778 | A | 10/1999 | Larson |
| 6,082,347 | A | 7/2000 | Darlington |

(Continued)

*Primary Examiner* — John E Simms, Jr.

(57) ABSTRACT

In at least one embodiment, an archery bow includes a rotatable member comprising a cam track, a capstan and a terminal. A drawstring extends from the first rotatable member. A power cable is attached to the terminal and extends away from the rotatable member. The power cable comprises an elongate straight portion located near the rotatable member, a capstan portion in contact with said capstan and a terminal portion in contact with said terminal. In a brace condition, the power cable wraps around the capstan in a first rotational direction as the power cable is traversed from the elongate straight portion to the terminal portion. When the bow is drawn from the brace condition, the rotatable member rotates in a second rotational direction that is opposite the first rotational direction.

19 Claims, 7 Drawing Sheets

(56) References Cited

U.S. PATENT DOCUMENTS

| | | | | |
|---|---|---|---|---|
| RE37,544 | E | 2/2002 | Darlington | |
| 6,360,735 | B1 | 3/2002 | Larson et al. | |
| 6,446,619 | B1 | 9/2002 | McPherson | |
| 6,516,790 | B1 * | 2/2003 | Darlington | F41B 5/10 124/25.6 |
| 6,691,692 | B1 | 2/2004 | Adkins | |
| 6,871,643 | B2 | 3/2005 | Cooper et al. | |
| 6,966,312 | B1 * | 11/2005 | Larson | F41B 5/10 124/25.6 |
| 6,990,970 | B1 | 1/2006 | Darlington | |
| 6,994,079 | B1 * | 2/2006 | Darlington | F41B 5/10 124/25.6 |
| 7,082,937 | B1 | 8/2006 | Land | |
| 7,188,615 | B2 | 3/2007 | Chang | |
| RE39,880 | E | 10/2007 | McPherson | |
| 7,305,979 | B1 | 12/2007 | Yehle | |
| 2004/0074485 | A1 * | 4/2004 | Cooper | F41B 5/10 124/25.6 |
| 2009/0188482 | A1 * | 7/2009 | Strother | F41B 5/10 124/25.6 |
| 2009/0288650 | A1 * | 11/2009 | Batdorf | F41B 5/10 124/25.6 |
| 2010/0051005 | A1 * | 3/2010 | Wilson | F41B 5/105 124/25.6 |
| 2010/0089375 | A1 | 4/2010 | McPherson et al. | |
| 2012/0222662 | A1 * | 9/2012 | Nebergall | F41B 5/10 124/25.6 |

* cited by examiner

ARCHERY BOW CAM

CROSS-REFERENCE TO RELATED APPLICATIONS

This application is a continuation of U.S. patent application Ser. No. 14/230,659, filed Mar. 31, 2014, which is a continuation of U.S. patent application Ser. No. 12/895,610, filed Sep. 30, 2010, now U.S. Pat. No. 8,683,989, which claims the benefit of U.S. Provisional Patent Application No. 61/247,473, the entire disclosures of which are hereby incorporated herein by reference.

BACKGROUND OF THE INVENTION

This invention relates generally to archery bows and more specifically to a cam configuration suitable for use in bows, such as a compound bow.

Archery bows are known in the art, and are generally configured for use by a particular user. Variable aspects of the bow, such as draw weight and draw length, are set to match the size and strength capabilities and preferences of the user. Adjustability of a bow allows for the bow to change with the user as the user's capabilities and preferences change over time. Adjustability also allows for a bow to be reconfigured for a different user.

There remains a need for novel bow and cam designs that provide for greater adjustability and are suitable for a wider range of potential users than prior art designs. There remains a need for novel bow and cam designs that allow for a greater range of draw weights and draw lengths to be achieved in a given bow.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, an archery bow comprises a riser, a first limb and a second limb supported by the riser, a first rotatable member supported by the first limb on a first axle and a second rotatable member supported by the second limb on a second axle. The first rotatable member comprises a cam track, a capstan and a terminal. A drawstring extends between the first rotatable member and the second rotatable member. A power cable is attached to said terminal and extends toward the second limb. The power cable comprises an elongate straight portion located near said first rotatable member, a capstan portion in contact with said capstan and a terminal portion in contact with said terminal. In a brace condition, the power cable wraps around the capstan in a first rotational direction as the power cable is traversed from the elongate straight portion to the terminal portion. When the bow is drawn from the brace condition, the first rotatable member rotates in a second rotational direction that is opposite the first rotational direction.

In at least one embodiment, a bow further comprises a second power cable and the second rotatable member comprises a second cam track, a second capstan and a second terminal. The second power cable is attached to the second terminal and extends toward the first limb. The second power cable comprises a second elongate straight portion located near the second rotatable member, a second capstan portion in contact with the second capstan and a second terminal portion in contact with the second terminal. In the brace condition, the second power cable wraps around the second capstan in the second rotational direction as the second power cable is traversed from the second elongate straight portion to the second terminal portion. When the bow is drawn from the brace condition, the second rotatable member rotates in the first rotational direction.

In at least one embodiment, the second rotatable member comprises a mirror image of the first rotatable member.

In some embodiments, in the brace condition, the elongate straight portion of the power cable defines a plane, wherein said first axle and said terminal are located on opposite sides of said plane.

In some embodiments, in the drawn condition, the capstan is located closer to the elongate straight portion than the terminal.

In some embodiments, in the brace condition, the power cable is not oriented in the cam track.

In some embodiments, a distance between the first axle and the terminal is greater than a distance between the first axle and the cam track.

In some embodiments, at least a portion of the cam track comprises a module that is attached to said first rotatable member. The module can be rotatable with respect to the first rotatable member and/or can be removable and replaceable with a separate module.

In at least one embodiment, an archery bow comprises a riser, a first limb and a second limb supported by the riser, a first rotatable member supported by the first limb on a first axle and a second rotatable member supported by the second limb on a second axle. The first axle and the second axle define an axle plane. The first rotatable member comprises a cam track, a capstan and a terminal. A drawstring extends between the first rotatable member and the second rotatable member. The drawstring leaves the first rotatable member at an exit location. A power cable is attached to the terminal and extends toward the second limb. The power cable comprises a capstan portion in contact with said capstan and a terminal portion in contact with said terminal. In a brace condition, the axle plane divides the first rotatable member to a first part and a second part, wherein the capstan and the terminal are located in the first part and the drawstring exit location is located in the second part. A distance between the terminal and the axle plane is greater than a distance between the capstan and the axle plane.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
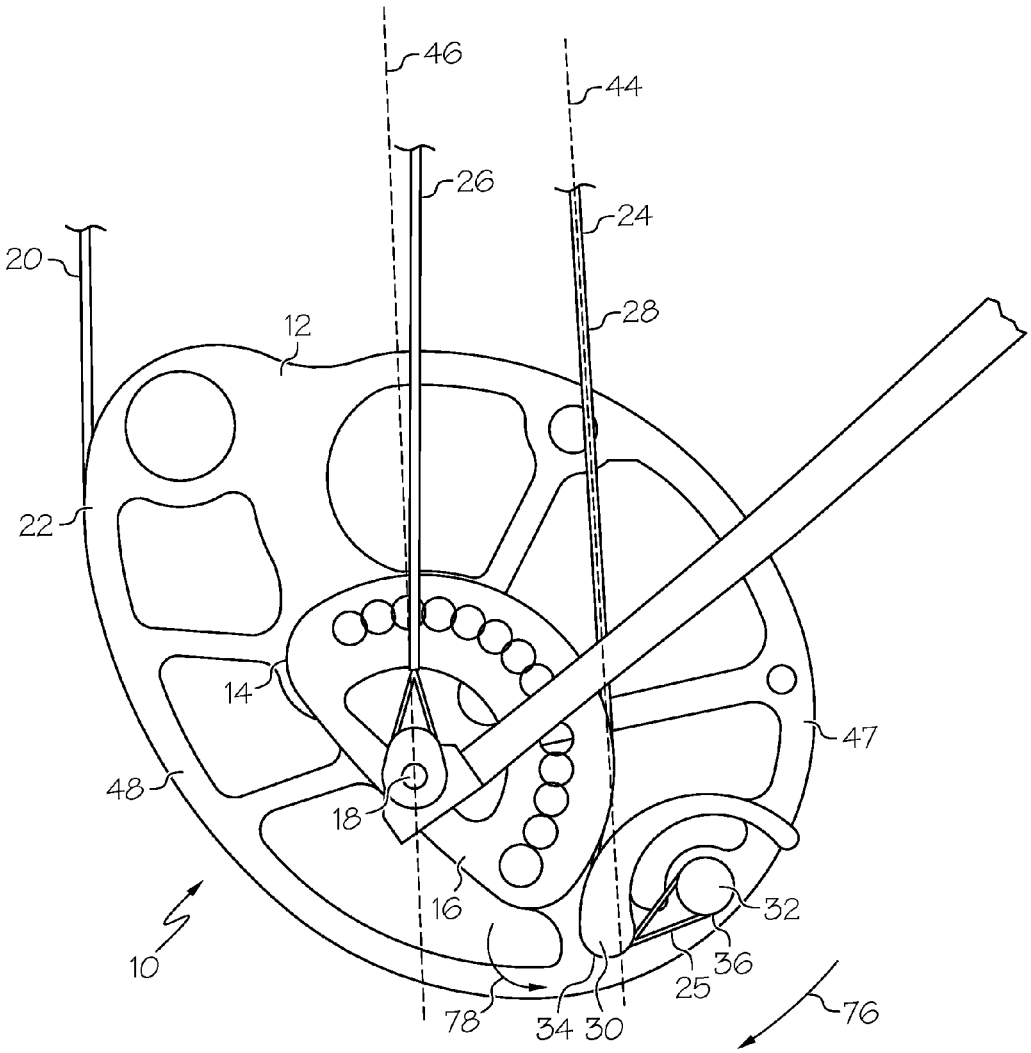
FIG. 1 shows an embodiment of a cam suitable for use in a bow. The cam is shown in a brace orientation.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 7:
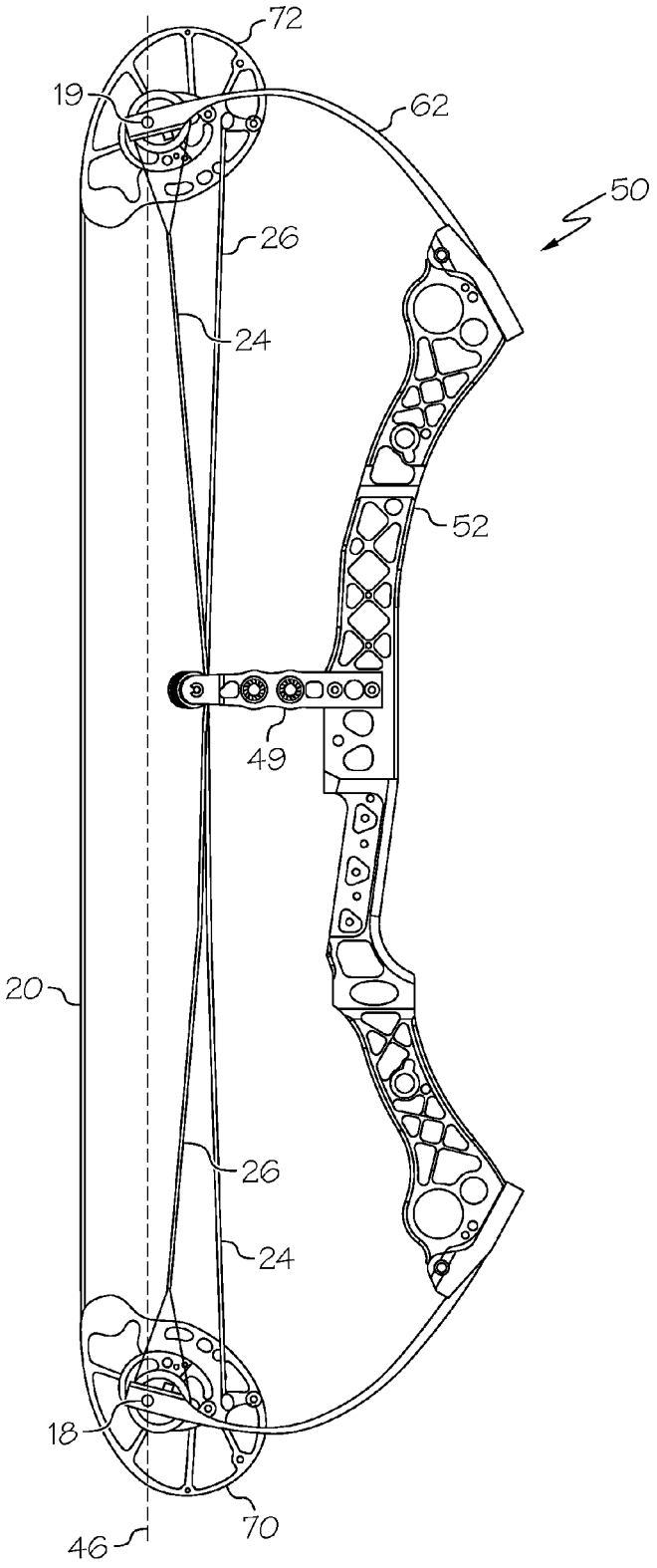
FIG. 7 shows an embodiment of a compound archery bow.

FIG. 7 shows an embodiment of a compound archery bow 50. Compound bows are generally known, for example as described in US 2010/0089375, the entire content of which is hereby incorporated herein by reference. Although FIG. 7 shows a two cam bow, the cam configurations disclosed herein can be used on any type of compound archery bow, such as single cam bows, 1.5 cam bows, binary cam bows, crossbows, etc.

In some embodiments, a compound bow 50 comprises a riser 52, a first limb 60 and a second limb 62. The first limb 60 supports a first rotatable member 70 on a first axle 18, and the second limb 62 supports a second rotatable member 72 on a second axle 19. The first and second axles 18, 19 define an axle plane 46. A drawstring 20 extends between the rotatable members 70, 72. As shown in FIG. 7, each rotatable member 70, 72 comprises a cam. The bow 50 comprises a power cable 24 that attaches to the first rotatable member 70 and extends toward the second limb 62, terminating on the second rotatable member 72, or in some embodiments, on the second axle 19 or second limb 62.

The bow of FIG. 7 further comprises a second power cable 26 that attaches to the second rotatable member 72 and extends toward the first limb 60, terminating on the first rotatable member 70, or in some embodiments, on the first axle 18 or first limb 60. In some embodiments, the configuration of the second rotatable member 72 is a mirror image of the first rotatable member 70. In some embodiments, the first and second power cables 24, 26 are essentially mirrored; however, a person of ordinary skill in the art would recognize that the cables 24, 26 may be held in a slightly displaced configuration by a cable guard 49.

The bow can be drawn throughout a plurality of draw orientations. An at-rest condition is generally considered a brace condition. The bow can be drawn by applying a rearward force to the drawstring 20, which causes the rotatable members 70, 72 to rotate. As the bow is drawn, the limbs 60, 62 flex and store energy. As the bow reached a fully drawn condition, the force required to hold back the drawstring 20 will let off due to the compounding configuration of the cam(s) and power cable(s).

Figure 2:
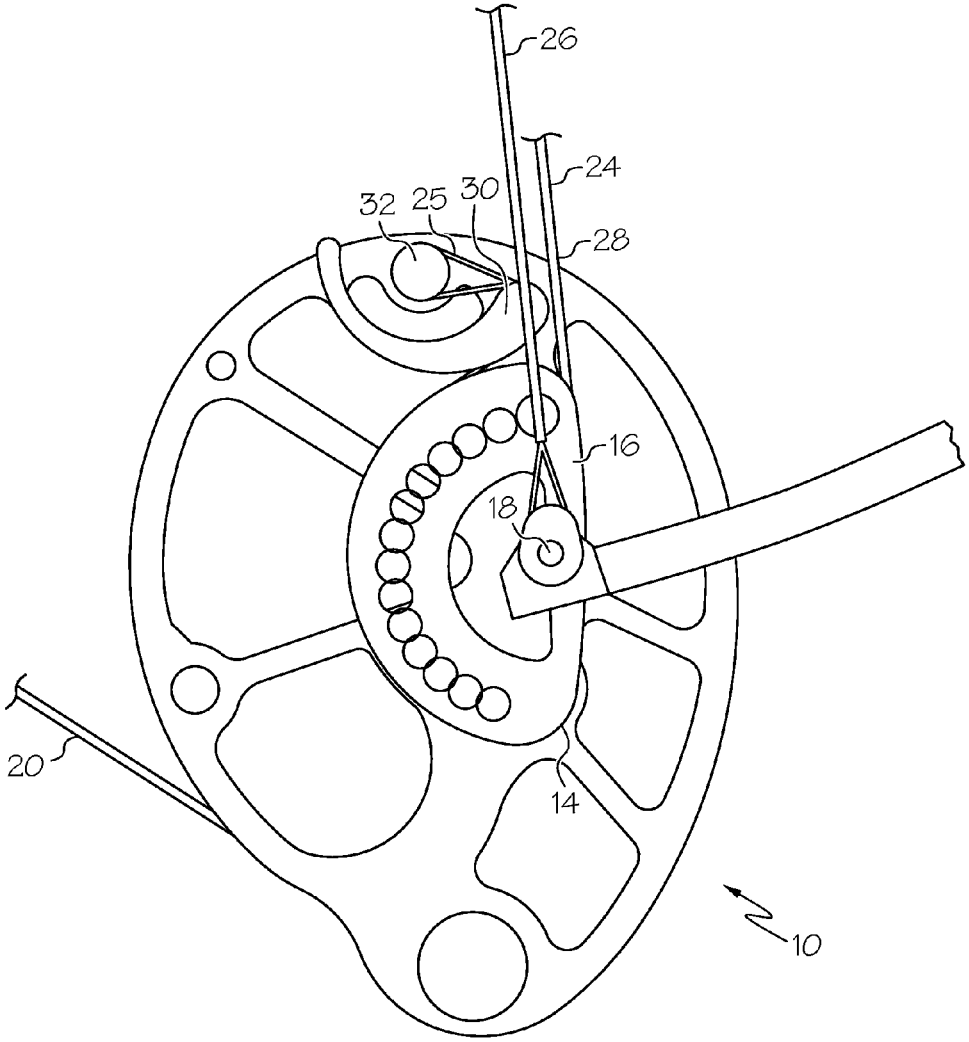
FIG. 2 shows the cam of FIG. 1 in a drawn orientation.
Figure 3:
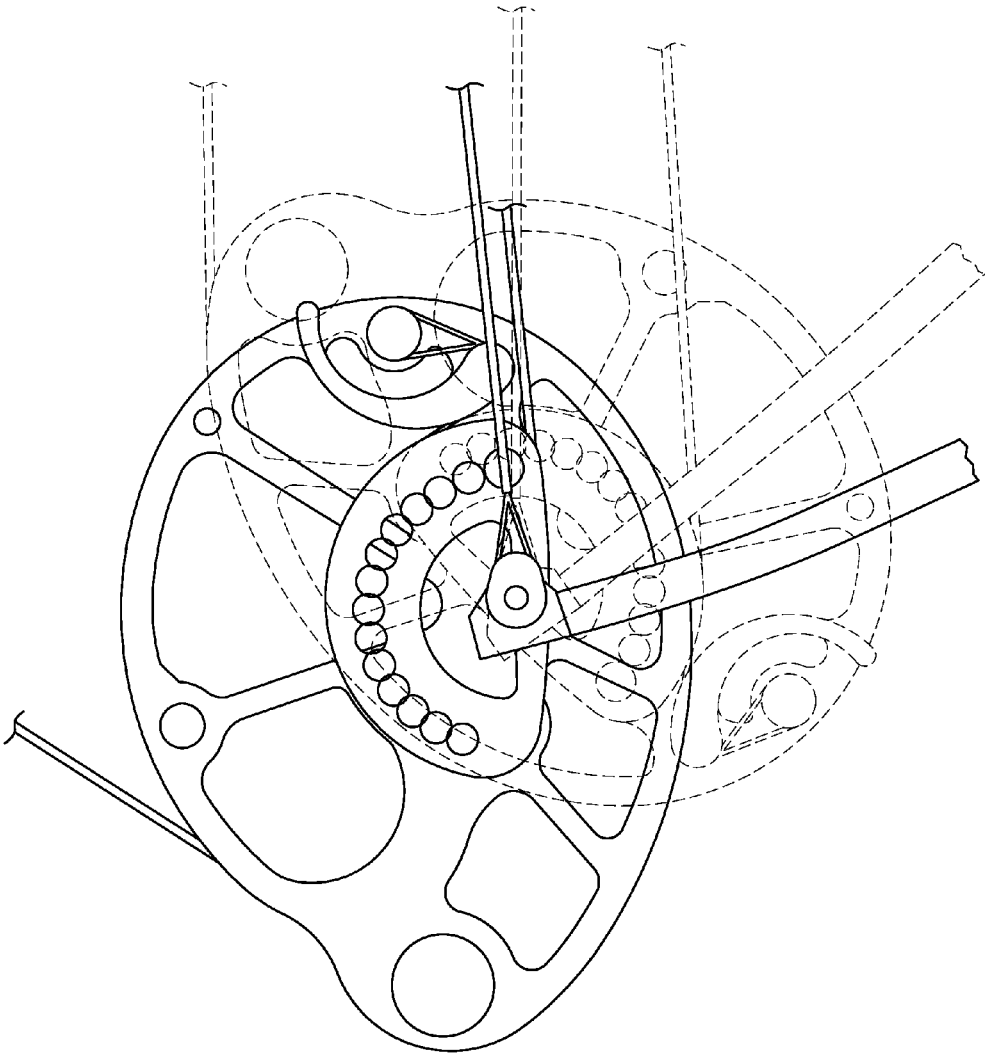
FIG. 3 is a combination of FIGS. 1 and 2, which shows how the cam rotates.

FIGS. 1-3 show an embodiment of a cam 10 that is suitable for use in a compound archery bow 50, for example as the first rotatable member 70 and/or the second rotatable member 72 shown in FIG. 7. A drawstring 20 is attached to the cam 10, which will typically extend to another rotatable member of the bow, such as a pulley or another cam, such as the second rotatable member 72 shown in FIG. 7. A first power cable 24 is also attached to the cam 10. The first power cable 24 is arranged to contact a cam track 14 as the bow is drawn. The specific contour of the cam track 14 can impact and/or control various characteristics of the bow, such as the draw force profile, the draw length, the amount of force let-off provided by the compounding action, etc.

In some embodiments, the cam 10 comprises a body portion 12 and an adjustable module 16. The adjustable module 16 comprises at least a portion of the cam track 14, the orientation of the module 16 is adjustable with respect to the body portion 12. The module 16 is typically fastened to the body portion 12 in one of a plurality of predetermined orientations. As shown in FIG. 1, the module 16 is rotatable about the axis of cam rotation, such as the axle 18. Adjustment of the module 16 with respect to the body portion 12 will change characteristics of the bow, such as the draw length. In some embodiments, a module 16 can be removed and replaced with a second, interchangeable module that has a different shape. Adjustable modules and interchangeable modules are also discussed in US 2010/0089375.

The first power cable 24 will extend from an opposite limb or rotatable member to the cam 10. A second power cable 26 is also shown, which terminates by attaching to the axle 18. In some embodiments, the first power cable 24 will contact a portion of the cam surface/track 14 in the brace condition, depending on the specific cam design. The first power cable 24 includes an elongate straight portion 28 located near the cam 10. The first power cable 24 extends around a capstan 30 and attaches to a terminal post 32. The power cable 24 comprises a capstan portion 34 in contact with the capstan 30 and a terminal portion 36 in contact with the terminal 32. Desirably, the capstan 30 comprises a groove or track for the cable 24, which is aligned in a common plane with the cam surface/track 14. In some embodiments, the capstan 30 comprises a portion of the cam body 12.

In some embodiments, the location of the terminal post 32 and the shape of the capstan 30 result in the power cable 24 wrapping around the capstan 30 in a direction away from the axle 18 before terminating on the post 32. In some embodiments, the cable wraps around the capstan 30 in a direction opposite the direction of cam 10 rotation as the bowstring 20 is drawn. As shown in FIG. 1, the cam 10 will rotate in a first rotational direction 76 (e.g. clockwise) when drawn, and the power cable 24 wraps around the capstan 30 and extends toward the terminal post 32 in a second rotational direction 78 (e.g. counter-clockwise) that is opposite the first rotational direction as the power cable 24 is traversed from the elongate straight portion 28 toward the terminal portion 36.

In some embodiments, the elongate straight portion 28 defines a cable plane 44, and the first axle 18 and the terminal 32 are located on opposite sides of the cable plane 44.

In some embodiments, a distance between the first axle 18 and the terminal 32 is greater than a distance between the first axle 18 and a portion of the cam track 14.

The drawstring 20 leaves the cam 10 at an exit location 22. The axle plane 46 described with respect to FIG. 7 is illustrated in FIG. 1. The axle plane 46 divides the cam 10 into a first part 47 and a second part 48. The capstan 30 and terminal 32 are located in the first part 47, and the drawstring 20 exit location 22 is located in the second part 48. A distance between the terminal 32 and the axle plane 46 is greater than a distance between the capstan 30 and the axle plane 46. Preferably, the distances are measured in a direction orthogonal to the axle plane 46—thus, the recited distances are the shortest distances between the axle plane 46 and the cam portions at issue.

The cam 10 shown in FIG. 1 is suitable for use in a two cam bow, wherein a second cam comprises a mirror image of the cam 10. The features shown and described with respect to FIG. 1 can be duplicated in mirror image and be used as a second rotatable member 72 as shown in FIG. 7. For example, the second power cable 26 shown in FIG. 1 would wrap around a second capstan and attach to a second terminal on the second cam. It should be noted that the second cam would rotate in the second rotational direction 78 and the second power cable 26 would wrap around the second capstan in the first rotational direction 76.

FIG. 2 shows the cam 10 of FIG. 1 in a drawn condition. The cam 10 has rotated about the axle 18 approximately 225 degrees from the condition of FIG. 1. The first power cable 24 extends around the adjustable module 16 contacting almost a complete periphery of the module 16. The first power cable 24 then wraps around the capstan 30 and terminates on the terminal post 32.

As shown in FIG. 2, the capstan 30 comes close to contacting the power cable 24, resulting in a portion the power cable 24 almost contacting itself. Such contact is often a limiting factor in cam design, which limits the amount of rotation that can be achieved. Having the cable 24 wrap around the capstan 30 and extend in a direction opposite of cam rotation provides for some added draw capability. From FIG. 2, it is clear that if the power cable 24 wrapped in the same direction as cam rotation, and the terminal post 32 were located on the other side of the capstan 30, rotation capability would be substantially diminished.

In some embodiments, the use of a capstan 30 is beneficial because the location of the power cable 24 as it wraps about the capstan 30 is effectively fixed. In various cam designs where a capstan 30 is not used, the power cable 24 often extends directly to the terminal post 32, allowing the power cable to rotate about the terminal post 32. Thus, the capstan 30 can be used to secure the power cable 24 such that it does not rotate about the terminal post 32. Also, a power cable 24 often splits to form a loop 25 at the terminal post 32. When an arrow is fired, high forces and vibrations are typically present in the cable 24. The capstan 30 causes reaction forces to be applied to portions of the cable 24 having a full cross-sectional area, whereas if the capstan 30 were omitted, reaction forces could be applied to the smaller cross-sectional area loop 25 portion.

As shown in FIG. 2, in the drawn condition, the first power cable 24 comprises an elongate straight portion 28 that is located near the cam 10 and extends away from the cam 10. In some embodiments, in the drawn condition, the capstan 30 is located closer to the elongate straight portion 28 than the terminal 32.

FIG. 3 shows a combination of FIGS. 1 and 2, wherein the subject matter of FIG. 1 (brace condition) is shown in dashed lines and the subject matter of FIG. 2 (drawn condition) is shown in solid lines.

Figure 4:
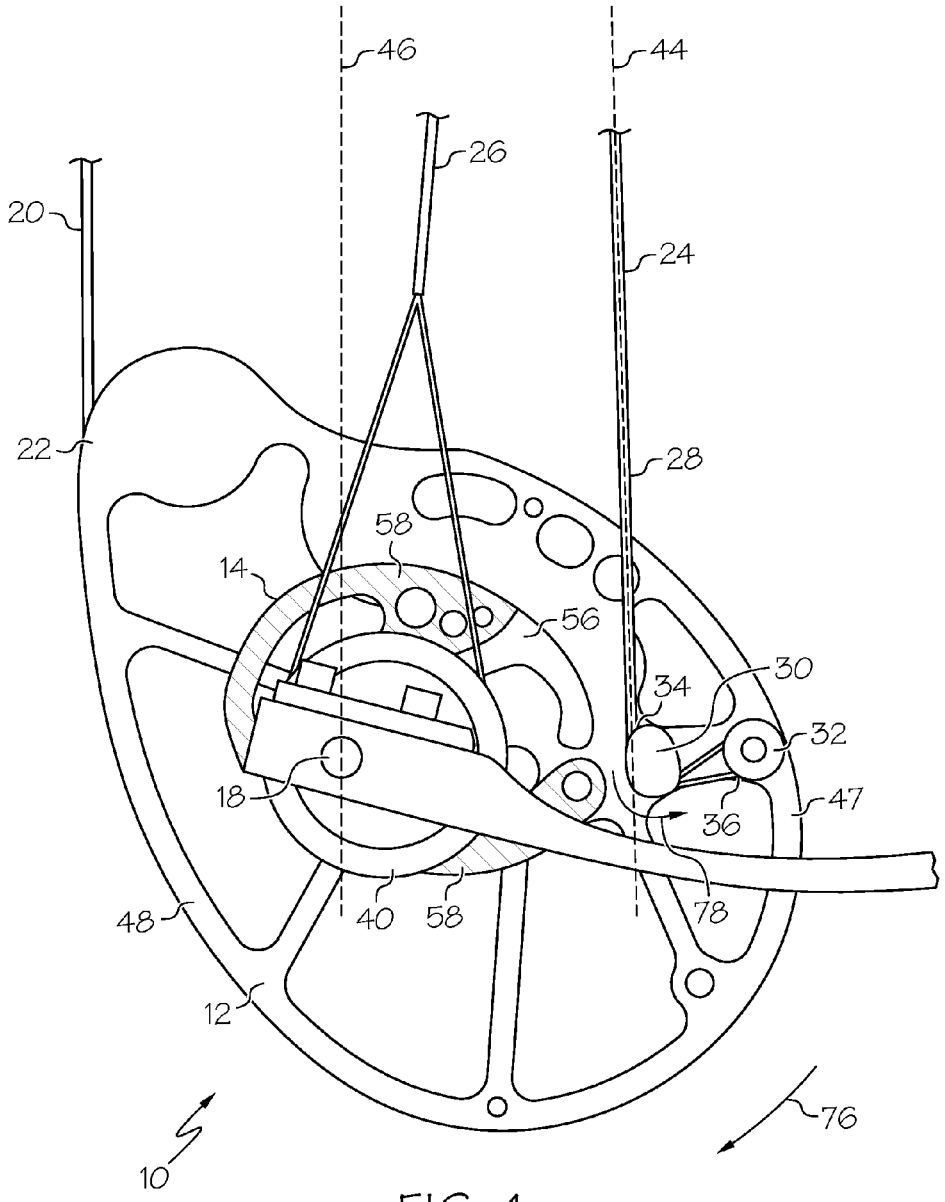
FIG. 4 shows another embodiment of a cam in a brace orientation.
Figure 5:
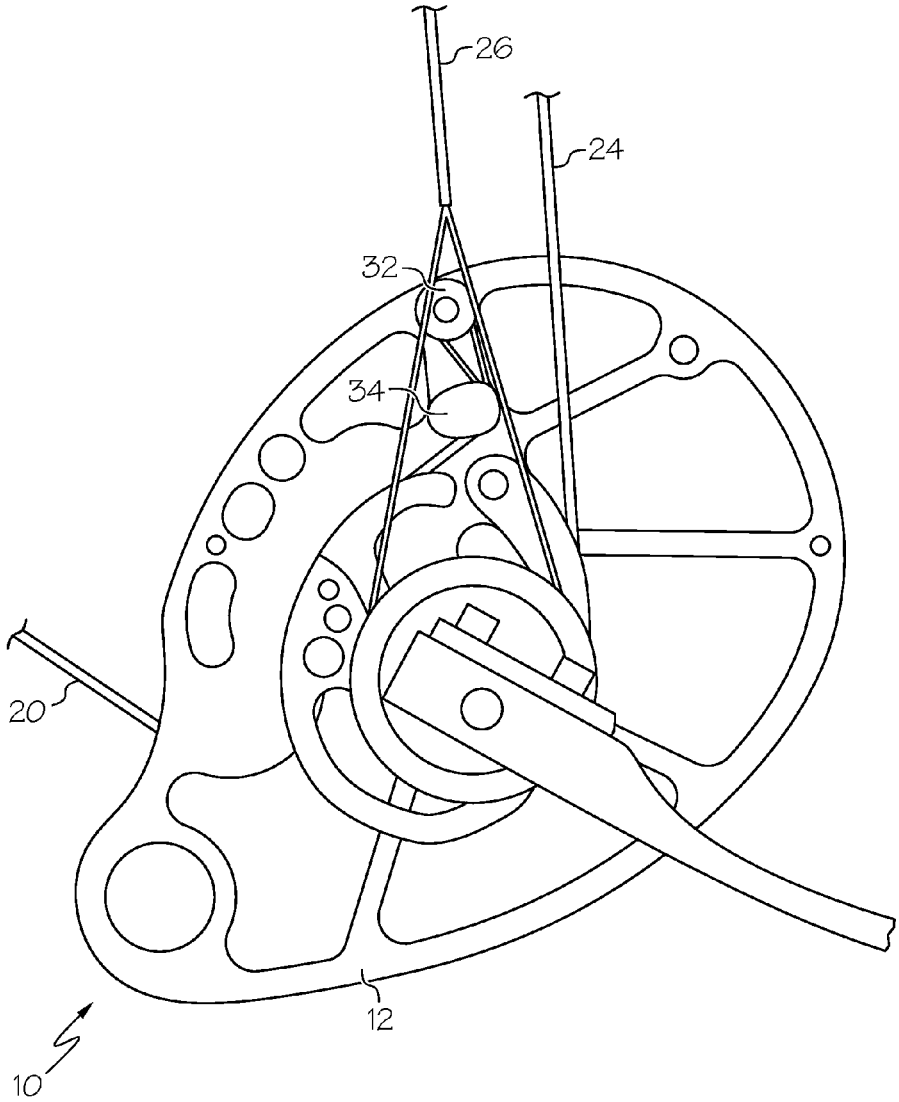
FIG. 5 shows the cam of FIG. 4 in a drawn orientation.
Figure 6:
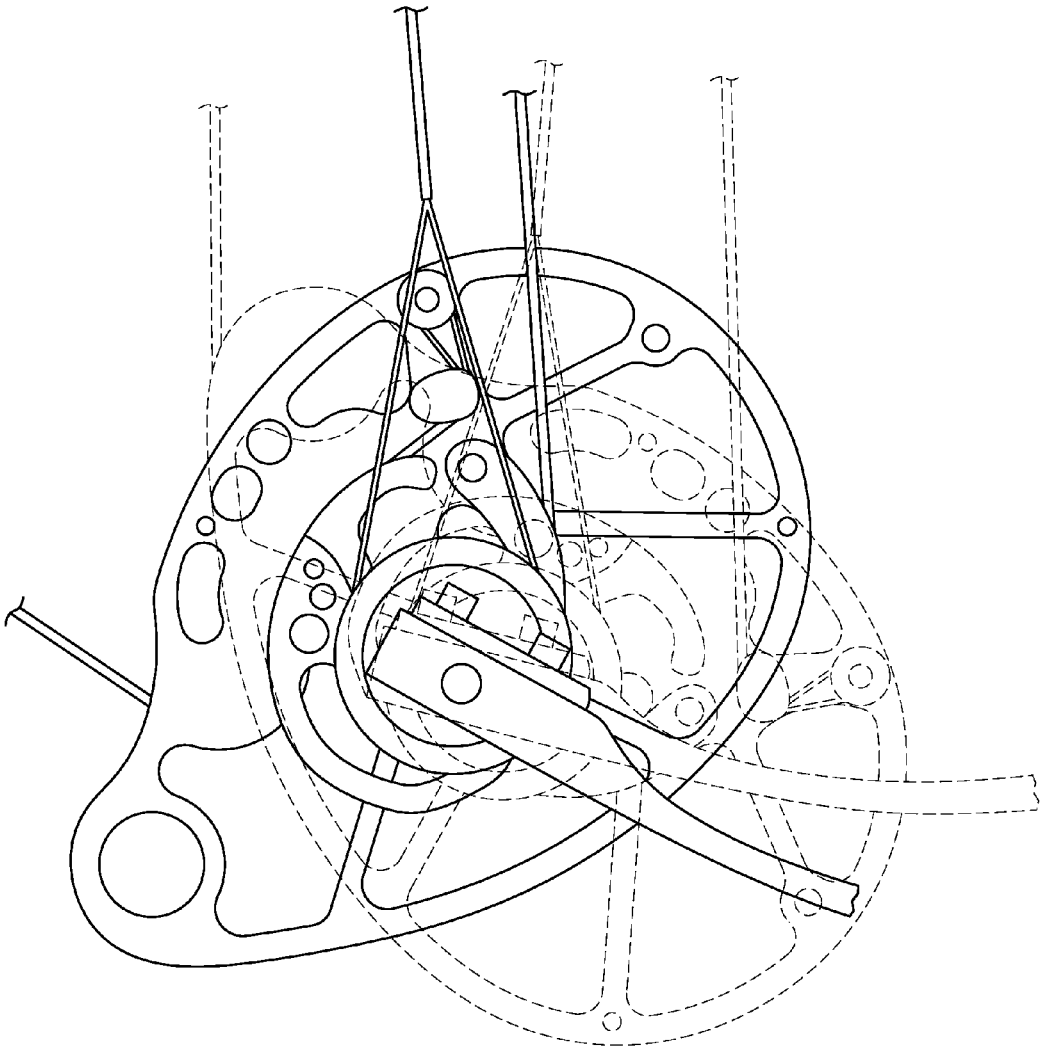
FIG. 6 is a combination of FIGS. 4 and 5, which shows how the cam rotates.

FIGS. 4-6 show another embodiment of a cam 10 in various orientations. FIG. 4 shows a brace orientation, FIG. 5 shows a drawn orientation and FIG. 6 shows the cam in both orientations. Like reference characters indicate like features when compared to FIGS. 1-3.

In FIG. 4, the first power cable 24 does not contact the cam surface 14 when in the brace condition. The capstan 30 works to locate and secure the power cable 24. The power cable 24 wraps around the capstan 30 and extends in a direction away from the axle 18. The power cable 24 wraps around the capstan 30 in the second rotational direction 78 as the power cable is traversed from the elongate straight portion 28 toward the terminal 32. The cam 10 rotates in the first rotational direction 76 as the bowstring 20 is drawn.

The cam track 14 comprises a fixed portion 56 and a removable portion 58. The removable portion 58 is shaded for clarification in FIG. 4. The removable portion 58 can be detached and replaced with another embodiment of a removable portion 58 that is shaped differently and is interchangeable. This allows the bow to be configured for different characteristics, such as changing draw length and/or draw weight.

When the power cable 24 does not contact the removable portion 58 of the cam track 14 in the brace condition, the removable portion 58 can be removed without the use of specialized bow servicing equipment, such as a bow press.

Preferably, the power cable 24 will initially contact the fixed portion 56 of the cam track 14 as the drawstring 20 is drawn.

In FIG. 4, a second power cable 26 attaches to a force vectoring anchor 40, for example as disclosed in US 2010/0089375.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow having a brace condition and a drawn condition, the archery bow comprising:

a riser;

a first limb and a second limb supported by the riser;

a first rotatable member supported by the first limb on a first axle, a second rotatable member supported by the second limb on a second axle, the first rotatable member comprising a cam track, a capstan and a terminal;

a drawstring extending between the first rotatable member and the second rotatable member;

a power cable attached to said terminal, said power cable extending from said terminal, wrapping around said capstan and extending toward the second limb;

wherein the capstan is located between the cam track and the terminal, and in the brace condition, the power cable wraps around the capstan in a first rotational direction as the power cable is traversed toward the terminal; and when the bow is drawn from the brace condition, the first rotatable member rotates in a second rotational direction that is opposite the first rotational direction.

2. The archery bow of claim 1, wherein a portion of the cam track is located between the capstan and the first axle.

3. The archery bow of claim 1, wherein, in the brace condition, the power cable is not oriented in said cam track.

4. The archery bow of claim 1, wherein a distance between the first axle and the terminal is greater than a distance between the first axle and the cam track.

5. The archery bow of claim 1, wherein at least a portion of said cam track comprises a module that is attached to said first rotatable member.

6. The archery bow of claim 5, wherein said module is adjustable between a plurality of orientations with respect to said first rotatable member.

7. The archery bow of claim 6, wherein said plurality of orientations comprises a plurality of rotational orientations about said first axle.

8. The archery bow of claim 5, wherein said module is interchangeable with a second module having a different shape.

9. The archery bow of claim 1, further comprising a second power cable, said second rotatable member comprising a second cam track, a second capstan and a second terminal, the second power cable attached to said second terminal, said second power cable wrapping around said second capstan and extending toward the first limb;

wherein the second capstan is located between the second cam track and the second terminal.

10. The archery bow of claim 9, wherein said second rotatable member comprises a mirror image of said first rotatable member.

11. An archery bow having a brace condition and a drawn condition, the bow comprising:

a riser;

a first limb and a second limb supported by the riser;

a first rotatable member supported by the first limb on a first axle, a second rotatable member supported by the second limb on a second axle, the first axle and the second axle defining an axle plane, the first rotatable member comprising a cam track, a capstan and a terminal;

a drawstring extending between the first rotatable member and the second rotatable member, the drawstring extending from the first rotatable member at an exit location;

a power cable attached to said terminal, extending away from said terminal, wrapping around said capstan and extending toward the second limb;

wherein, in the brace condition, the axle plane divides the first rotatable member to a first part and a second part, the capstan and the terminal located in the first part, the drawstring exit location located in the second part, and a distance between the terminal and the axle plane is greater than a distance between the capstan and the axle plane.

12. The archery bow of claim 11, wherein said distance between the terminal and the axle plane is measured orthogonal to said axle plane, and said distance between the capstan and the axle plane is measured orthogonal to said axle plane.

13. The archery bow of claim 11, wherein, in the brace condition, said power cable comprises an elongate straight portion located near said first rotatable member, the elongate straight portion defines a cable portion plane, said first axle and said terminal are located on opposite sides of said cable portion plane.

14. The archery bow of claim 11, wherein, in the drawn condition, said power cable comprises an elongate straight portion located near said first rotatable member, the capstan located closer to the elongate straight portion than the terminal.

15. The archery bow of claim 11, wherein a distance between the first axle and the terminal is greater than a distance between the first axle and the cam track.

16. The archery bow of claim 11, wherein, in the brace condition, the power cable is not oriented in said cam track.

17. The archery bow of claim 11, wherein at least a portion of said cam track comprises a module that is attached to said first rotatable member, the module being removable or repositionable.

18. The archery bow of claim 11, further comprising a second power cable, said second rotatable member comprising a second cam track, a second capstan and a second terminal, the second power cable attached to said second terminal and extending toward the first limb, said second power cable comprising a second capstan portion in contact with said second capstan and a second terminal portion in contact with said second terminal, the drawstring extending from the second rotatable member at a second exit location;

wherein, in the brace condition, the axle plane divides the second rotatable member to a first part and a second part, the second capstan and the second terminal located in the first part, the second drawstring exit location located in the second part, and a distance between the second terminal and the axle plane is greater than a distance between the second capstan and the axle plane.

19. The archery bow of claim 18, wherein said second rotatable member comprises a mirror image of said first rotatable member.

* * * * *